US009087495B2

(12) United States Patent
Sanders

(10) Patent No.: US 9,087,495 B2
(45) Date of Patent: Jul. 21, 2015

(54) VALVE SYSTEM FOR BRASS INSTRUMENTS

(71) Applicant: Wilhelmus Karolus Sanders, Karlsruhe (DE)

(72) Inventor: Wilhelmus Karolus Sanders, Karlsruhe (DE)

( * ) Notice: Subject to any disclaimer, the term of this patent is extended or adjusted under 35 U.S.C. 154(b) by 0 days.

(21) Appl. No.: 14/399,040

(22) PCT Filed: Mar. 15, 2013

(86) PCT No.: PCT/DE2013/200007
§ 371 (c)(1),
(2) Date: Nov. 5, 2014

(87) PCT Pub. No.: WO2013/167125
PCT Pub. Date: Nov. 14, 2013

(65) Prior Publication Data

US 2015/0114203 A1 Apr. 30, 2015

(30) Foreign Application Priority Data

May 9, 2012 (DE) ..... 20 2012 004 570 U

(51) Int. Cl.
*G10D 9/04* (2006.01)

(52) U.S. Cl.
CPC ..... *G10D 9/04* (2013.01)

(58) Field of Classification Search
CPC ..... G10D 7/10; G10D 9/00; G10D 9/02; G10D 9/04; G10D 7/005; G10D 9/043; G10D 7/00; G10D 7/026; G10D 7/08; G10D 7/04; G10D 7/063; G10D 13/026; G10D 3/00; G10D 7/06; G10D 9/005; G10D 9/026; G10D 13/00
USPC ..... 84/380 R, 390, 387 R, 387 A
See application file for complete search history.

(56) References Cited

U.S. PATENT DOCUMENTS

| | | | |
|---|---|---|---|
| 5,919 | A | 11/1848 | Paine |
| 530,781 | A | 12/1894 | Leland |
| 3,554,072 | A | 1/1971 | Hirsbrunner |

FOREIGN PATENT DOCUMENTS

| | | | |
|---|---|---|---|
| CH | 495 600 | A | 8/1970 |
| DE | 559 300 | C | 9/1932 |
| DE | 94 06 839 | U1 | 7/1994 |
| DE | 10 2005 002918 | A1 | 10/2005 |
| DE | 20 2006 008088 | U1 | 9/2007 |
| EP | 0 135 643 | A1 | 4/1985 |

OTHER PUBLICATIONS

International Search Report for Corresponding International PCT Application No. PCT/DE2013/200007.

*Primary Examiner* — Kimberly Lockett
(74) *Attorney, Agent, or Firm* — Lowe Hauptman & Ham, LLP

(57) ABSTRACT

A valve system for brass instruments comprising mechanically actuated rotary valves rotatably mounted in valve sleeves, and tube sockets for tubes which conduct the air flow in and out and for valve tube loops. The valve system has a milled valve block, in which a bore is arranged which runs through the valve system rectilinearly and with a constant cross section through the valve sleeves, into which bore bores open which run approximately at right angles to said bore and have the same cross section as the valve tube loops. The bores are connected to one another during valve actuation by way of the rotatable valve cylinders and bores arranged therein. The bores run approximately rectilinearly through the valve cylinder and correspond in terms of their cross section to the further bores, and the valve sleeves likewise are milled directly into the valve block.

4 Claims, 2 Drawing Sheets

VALVE SYSTEM FOR BRASS INSTRUMENTS

Figure 1:
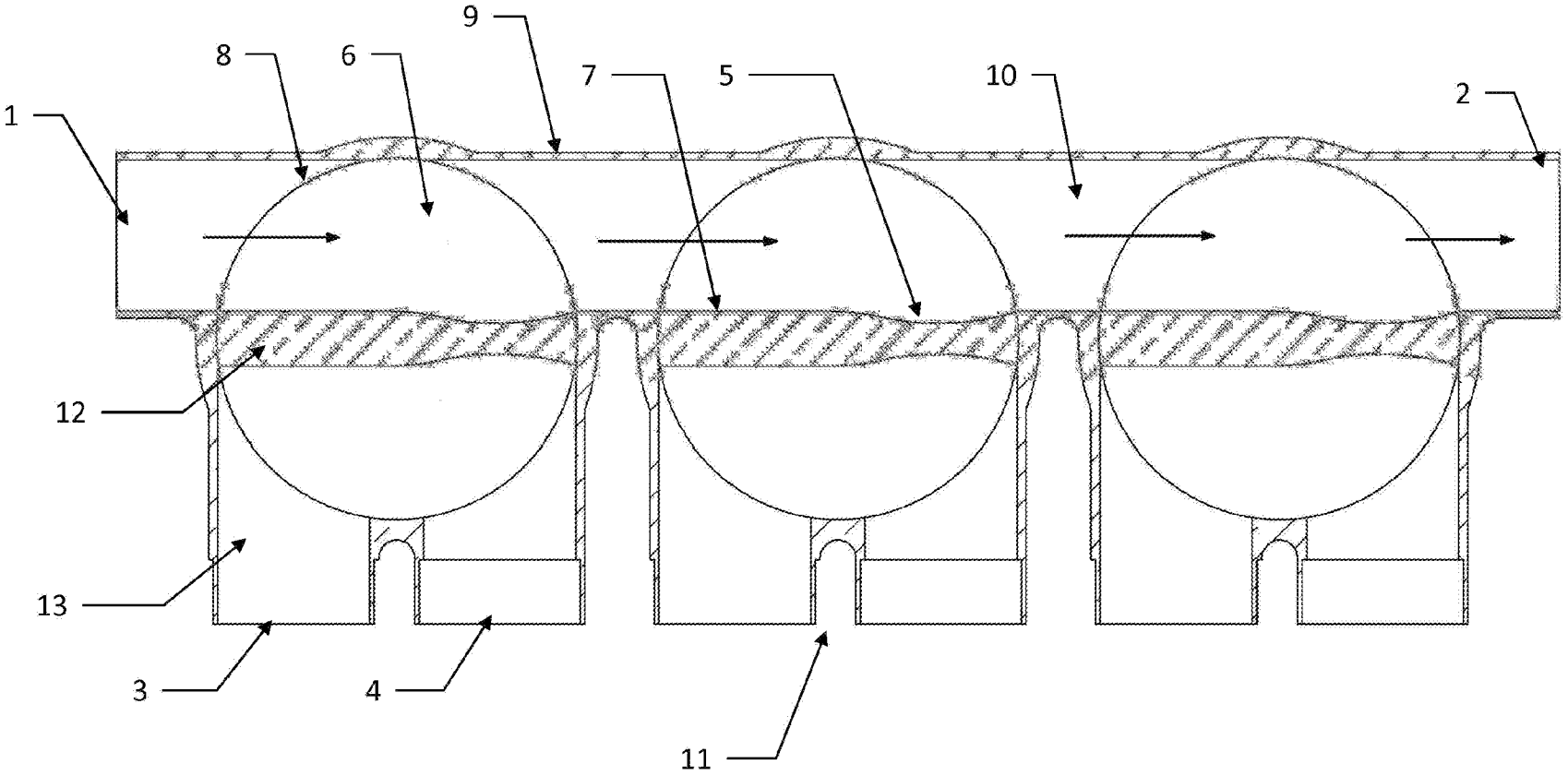

The invention relates to a valve system for brass instruments in accordance with the preamble of patent claim 1.

The pitch and intonation when playing on brass instruments such as trumpets, horns, trombones and tubas are changed, in addition to by the blowing technique and lip modulation, by mechanical valves on the instruments, which mechanical valves as a rule can be actuated via spring-loaded levers and mechanical joints or else a cable mechanism. Upon actuation of the valves, the air is guided in the instrument through alternative tube loops of a defined length, in order thus to be able to lower the natural pitch by from one to three semitones by way of the extension of the tube path. Here, the loaded valve tube loops are as a rule configured in such a way that cylindrical bores make a valve tuning slide possible for precision tuning of the valve tube loops.

Here, the present invention relates to a valve system having rotary valves which have a valve body with two channels, which valve body performs a rotation about 90° of its vertical axis upon actuation of the valve and thus carries out the bypassing of the air into the valve tube loop. A rotary valve of this type for brass instruments is disclosed, for example, in document DE 30 13 646, the claim here being directed to improving discontinuities in the air guiding.

According to the disclosure of DE 30 13 646, it is a fundamental problem in rotary valves that a deflection of the air flow has to take place, it being necessary for a quadruple deflection by in each case 90° to take place. The approach for improvement according to this publication is that the entire directional change of the air flow is reduced by way of a change of the bores in the valve and of the attachment of the loops to the valve, and thus the resistance as a result of flowing around the edges is reduced.

This is to be achieved by way of flatter bores toward the valve tube loops, which bores are not directed toward the valve body center point. Here, the bores for the inlet and outlet of the main tuning slide into the valve are still carried out classically in the direction of the center point of the valve, corresponding loops being provided here as connecting elements between the valve and the tube which feeds the air flow in. Said loops are therefore still angled away in a standard manner at the inlet into the valve and are of straight configuration in the region of the transition into the valve tube loops, as a result of which the lower deflection effort is produced.

It is the inventive approach of the present invention to further improve the valve construction, a completely new basic construction being proposed. Here, the primary difference in the construction of the rotary valves results when blowing the natural pitch which is to oscillate through the instrument in the invention without deflection by way of the rotary valve. In the previous rotary valves, there was always a constriction or deflection of the air flow here, even in the case of non-actuated valves, since the valve passages already have inaccuracies, steps and constrictions of the cross section purely as a result of the manufacture, which makes the playing and response of the instrument difficult.

In conventional valve housings, there is therefore a disruption of the air flow in the case of non-actuated valves, such as, for example, in the case of the above-described construction of DE 30 136 46 A1, since the air flow is always guided by way of the bypass via the attached loops into the rotary valve, even in the case of a non-actuated valve, through the first valve housing with a valve body and is again deflected into the next loop and the transition tube section to the next valve housing and thus experiences a deflection and possibly constriction.

The disclosure according to the publication EP 0135643 likewise has said disadvantages even if said invention concentrates explicitly on improvements in the construction of rotary valves. It is also argued here that the addressed deflections and constrictions have a disadvantageous effect, for which reason it is proposed to configure the cross-sectional areas of the tube sockets, connecting tubes and the passages of the valve changes to be constant and to configure all the transitions between said components to be smooth and stepless. It is to be assumed that an improvement can be achieved in this way.

Against this background, it is the object of the present invention to provide a valve system for brass instruments, which valve system makes an air flow which is as straight and homogeneous as possible through the valve system of the instrument possible in the case of open valves. As a result, blowing and response of the instrument are to be improved and a balanced sound is to be achieved in all registers.

In the valve system according to the invention, this problem of the constriction and deflection of the air flow in the open valve system does not exist, since the air is guided rectilinearly through the valve system consisting of the valve sleeves which are arranged such that they are connected one behind another, in the case of a non-actuated valve. According to the invention, this is achieved by way of a valve system configured as a valve block or valve housing which has a continuous straight bore, the rotary valves which are used being configured in such a way that, when they are not actuated, they form merely an extension or a continuation of the cross section of the rectilinearly continuous bore.

That is to say, in the present construction the valve block is machined from one basic body and is not, as customary in the prior art, a complicated connection of individual components such as valve sleeve, attached loops and tube pieces. The valve block therefore accommodates the main slide of the blowing tube of the instrument and guides it rectilinearly and with a constant cross section as a continuous bore through the valve sleeves which are arranged at right angles with respect hereto. A connection of the valve sleeves to one another by way of loops and tube sections is therefore dispensed with. The valve block is correspondingly machined from one piece with the bores and valve sleeves.

This thus results in the advantageous option of guiding the bores for attaching the tubes of the wind instrument in a completely straight manner through the valve sleeves. An attachment of loops as deflecting connecting bodies between the valve sleeve and the tube is therefore superfluous. The result of this in practice, in particular during blowing, is an ideal natural tone generation, since the air flow can oscillate through the instrument without constriction and deflection.

Here, the deflection into the valve tube loops, for example, of a horn takes place with a greater deflection than it does, for example, in the prior art of EP 0135 643 A1 by way of the guidance of the attached loops on the valve sleeve; however, this surprisingly does not represent a disadvantage, but rather even makes clearer accentuation and separation of the tones possible during valve actuation. That is to say, the greater deflection of the air flow into the valve tube loop as a result of the valve system according to the invention advantageously brings about greater response of said tones and therefore even represents an advantage over conventional constructions. As a result of the exact machining of the bores in the valve block which can take place from one workpiece block by way of computer-controlled milling machines, the cylindrical connection of said bores in the transition to the cylindrical bores in the valve cylinders is configured to be considerably more accurate and so complete that this also brings about the greater and more accentuated response of the tones.

In the case of the bores in the valve cylinder which is mounted rotatably in the valve sleeve, one advantageous embodiment of the invention provides that they are configured in a slightly S-shaped curved manner, upon actuation of the valve in the inlet region into the valve cylinder. Said bore is of rectilinear configuration in the transition to the valve tube loops and in the outlet section in the actuation position. Although the deflection is still approximately at a right angle with the abovementioned positive effects, improvements in the air guidance result, in particular, in the case of the actuated valves, since the slightly curved course reduces the air resistance at the inlet into the valve block. The air flow is intercepted more gently and is fed homogeneously to the valve tube loop without a change in cross section. In addition, in said construction, the air flow experiences an acceleration during the valve actuation and rotation by 90°, as a result of which the tones can be produced in the center of the sound in an improved manner. In this way, the player can achieve a softer legato.

Ball bearings are a further advantageous and novel element, in which the valve cylinder which is rotated in the valve sleeve by 90° in order to deflect the air flow is guided on the top and bottom sides. This achieves a situation where the valve cylinder is moved without friction in the valve sleeve, that is to say the valve cylinder is not rotated in a manner which rubs along the wall of the valve sleeve during the rotation. This makes both easier actuation of the valve and a lower development of noise when playing possible. In particular, it is also an improvement in relation to the resonance of the instrument, since no disruptive resonances at all are any longer transmitted to the instrument body as a result of the friction of the valve cylinder in the valve sleeve. The instrument can thus oscillate as a resonance body in a non-disrupted manner.

Figure 2:
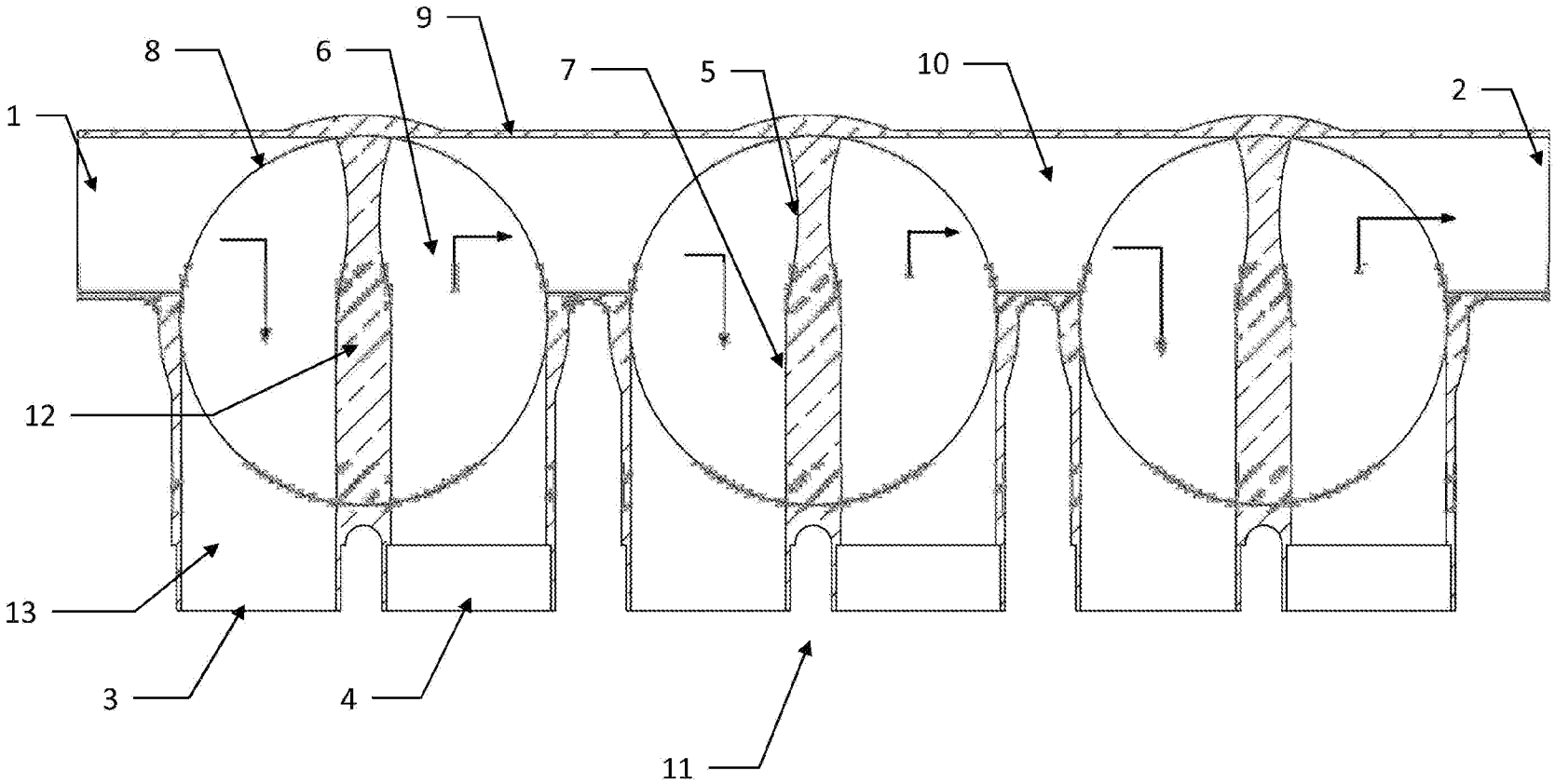

In the following text, the invention is to be explained in greater detail using drawings, in which:

FIG. 1 shows a plan view of the valve system with sectioned valve cylinders in open valve sleeves in the case of non-actuated valves, and FIG. 2 shows a plan view of the valve system with sectioned valve cylinders in open valve sleeves in the case of actuated valves.

The air flow of the blowing tube is fed through the opening 1 of the valve system 9 to the valve system 9, the air flow being shown diagrammatically by way of arrows. In the figure, said air flow flows rectilinearly through the valve system and is impeded neither by constrictions of the cross section nor by deflections.

It becomes clear here that this is an elementary change in comparison with conventional valve systems. There is a slight curve in the form of a tapering of the wall thickness of the inner wall of the valve change merely in the region at the outlet of the bore 6 in the valve cylinder 12. The front section 7 of the bore 6 is exactly consistent with the cross section of the tube feed 1 into the valve system.

It can be seen in principle that a continuous bore 10 of constant cross section runs through the valve system or the valve block 9. The valve block 9 is therefore milled from one block. Here, both the outer contour and the attachments 1 and 2 for the main slide and the attachments 3 and 4 for the valve tube loops 11 are milled from the block, as are furthermore the cylindrical valve sleeves 8 and the bore 10 and the bores to the valve tube loops 11, which bores are connected to said bore 10 at a right angle.

FIG. 2 once again shows said valve system with actuated valve cylinders 12. They are thus rotated by 90° in the valve sleeve 8. The arrows clarify that the air flow is now deflected at a right angle from the inlet 1 into the valve system through the bore 6 in the valve cylinder 12, this deflection running more gently in the embodiment which is shown as a result of the slightly curved course of the bore 6 in the front region 5. In that region 7 to the valve tube loops 11 which is now at the rear in the rotated position of the valve cylinder 12, said bore 6 runs exactly in terms of cross section in a manner which corresponds to the adjoining valve tube loops 11.

The invention claimed is:

1. A valve system for brass instruments comprising mechanically actuated rotary valves which are mounted rotatably in valve sleeves (8), and tube sockets (1, 2, 3, 4) for tubes which conduct the air flow in and out and for valve tube loops (11), wherein the valve system has a milled valve block (9), in which a bore (10) is arranged which runs through the valve system rectilinearly and with a constant cross section through the valve sleeves (8), into which bore (10) bores (13) open which run approximately at right angles to said bore (10) and have the same cross section as the valve tube loops (11), said bores (10 and 13) being connected to one another during valve actuation by way of the rotatable valve cylinders (12) and bores (6) arranged therein, said bores (6) running approximately rectilinearly through the valve cylinder and corresponding in terms of their cross section to the further bores (10 and 13), and the valve sleeves (8) likewise being milled directly into the valve block (9).

2. The valve system for brass instruments as claimed in claim 1, wherein the bores (6) in the valve cylinder (12) which is mounted rotatably in the valve sleeve (8) are configured at least in one end region (5) in a slightly approximately S-shaped curved manner, said end region (5) being turned into the deflection region into the bores (10) upon actuation of the valve and forwarding the air flow more softly here and feeding it homogeneously to the valve tube loop (11) without a change in cross section.

3. The valve system for brass instruments as claimed in claim 2, wherein the valve cylinder (12) is guided on the top and bottom sides in a ball bearing and thus is rotatable in the valve sleeve (8) in a friction-free manner in relation to said valve sleeve (8).

4. The valve system for brass instruments as claimed in claim 1, wherein the valve cylinder (12) is guided on the top and bottom sides in a ball bearing and thus is rotatable in the valve sleeve (8) in a friction-free manner in relation to said valve sleeve (8).

* * * * *